United States Patent [19]

McWhirter

[11] 4,180,030

[45] Dec. 25, 1979

[54] VALVE LOCK ASSEMBLY

[76] Inventor: John A. McWhirter, 2806 Hangar Rd., Memphis, Tenn. 38118

[21] Appl. No.: 834,819

[22] Filed: Sep. 19, 1977

[51] Int. Cl.[2] ..... F01L 3/10

[52] U.S. Cl. ..... 123/90.67; 123/188 VA; 123/188 SC

[58] Field of Search ..... 123/90.67, 188 SB, 188 SC, 123/188 GC, 188 VA, 188 AF; 251/337

[56] References Cited

U.S. PATENT DOCUMENTS

| | | | |
|---|---|---|---|
| 2,142,224 | 1/1939 | Turlay | 123/188 SC |
| 2,776,652 | 1/1957 | Crotty | 123/188 GC |
| 3,043,284 | 7/1962 | Gundstrom | 123/90.67 |
| 3,077,874 | 2/1963 | Bush | 123/90.67 |
| 3,164,366 | 1/1965 | Tauschek | 123/188 VA |
| 3,311,341 | 3/1967 | Vironda et al. | 251/337 |
| 3,656,461 | 4/1972 | Renger et al. | 123/188 AF |
| 3,786,797 | 1/1974 | Eade et al. | 123/188 VA |

*Primary Examiner*—Charles J. Myhre
*Assistant Examiner*—David D. Reynolds

[57] ABSTRACT

A device for attaching a valve stem to a valve spring retainer. The device includes two wedge-like key members for wedgably locking the valve spring retainer to the valve stem. Each key member has a cavity for receiving a portion of a cup-shaped lash cap which is mounted on the distal end of the valve stem.

12 Claims, 5 Drawing Figures

VALVE LOCK ASSEMBLY

BACKGROUND OF THE INVENTION

1. Field of the Invention

The present invention relates to a valve stem assembly in internal combustion engines.

2. Description of the Prior Art

Heretofore various means have been developed for the purpose of attaching a valve spring retainer to the distal end of the valve stem.

One prior means utilizes two wedge-shaped key members. Each key member includes a projection for extending into a recess in the distal end of the valve stem to accurately position each key member on the distal end of the valve stem with the upper portion of each key member being substantially flush with the tip of the distal end of the valve stem. However, this device is disadvantageous since, for example, a normal cup-shaped lash cap cannot be used therewith.

A similar prior means of attaching a valve stem to a valve spring retainer is one developed by Chrysler Corporation for use in its 426 Hemi engine and is composed of two key members similar to the above means but the top of each key member is removed to accomodate a cup-shaped lash cap in a recess then formed between the side of the distal end of the valve stem and the inner edge of the valve stem retainer. One purpose of the lash cap is to present an enlarged bearing surface for the rocker arm to contact as will be apparent to those skilled in the art. However, this means is disadvantageous in that when the upper portion of the key members is removed the lock will lose a great deal of strength making it disadvantageous for use in certain conditions.

Another prior means was developed by Crane Cams and is similar in that each of the two key members (identified by the Crane Cams part number 99093) has a projection for extending into a groove in the distal end of the valve stem and the upper portion of each wedge-shaped key member is again removed for receiving the lash cap, but the upper portion of these key members is thicker than the above described key members. Each of these key members is also longer than the Chrysler Corporation key members because Crane Cams extended the lower portion down the side of the valve stem. However, due to the inherent weakness caused by the loss of the upper portion this device is still disadvantageous in extreme conditions.

Heretofore, various patents have been issued relating generally to the present invention. See, for example: Engemann, U.S. Pat. No. 2,827,891; Cousino, U.S. Pat. No. 3,021,593; Bush, U.S. Pat. No. 3,077,874; Thompson, U.S. Pat. No. 3,298,337; Iskenderian, U.S. Pat. No. 3,853,101; and Toth, U.S. Pat. No. 3,978,830. None of the above patents disclose or suggest the present invention.

SUMMARY OF THE INVENTION

The present invention is directed towards overcoming the problems and disadvantages of prior means for locking or attaching a valve spring retainer and a valve stem together. The concept of the present invention is to provide such a lock means which allows a cup-shaped lash cap to be utilized in conjunction with the valve spring retainer and valve stem and which includes means for being wedged between the valve spring retainer and the valve stem to lock the valve spring retainer and the valve stem together, and for receiving a portion of the lash cap.

Preferably, the valve lock means of the present invention includes two wedge-shaped key members for being wedged between the valve spring retainer and the valve stem. Each key member preferably includes a cavity for receiving a portion of the lash cap. Further, the improved valve lock means has substantial advantanges such as increased strength in that the valve assembly is much less likely to fail under extreme conditions. The improved valve lock means also has an enlarged surface area capable of receiving a roller or a conventional type rocker arm. The improved valve lock means also is designed for use with a standard valve stem and lash cap so that these parts do not need to be modified. Further objects and advantages of the present invention will become apparent to those skilled in the art from the following detailed description made with reference to the accompanying drawings.

DESCRIPTION OF THE PREFERRED EMBODIMENT

Figure 1:
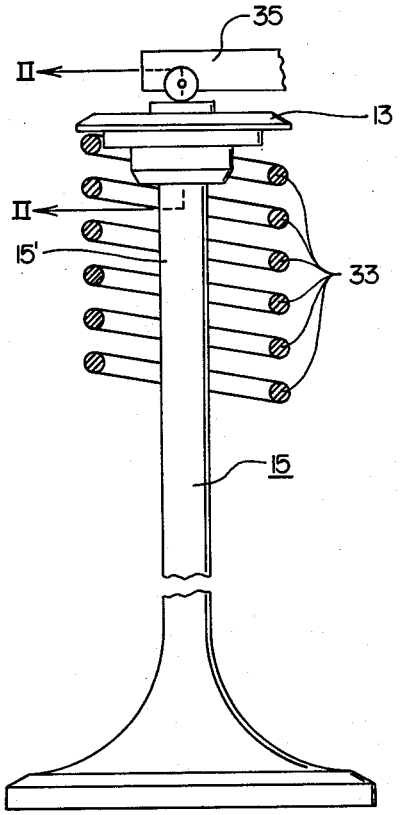
FIG. 1 is a side elevational view of the valve lock means of the present invention shown associated with a valve assembly.
Figure 2:
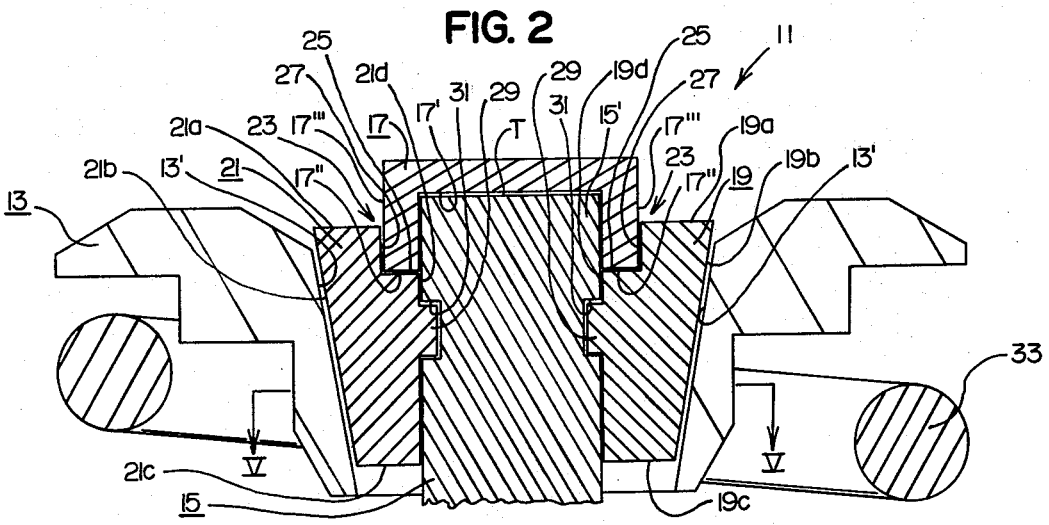
FIG. 2 is an enlarged sectional view of a portion thereof as taken from line II—II of FIG. 1.
Figure 3:
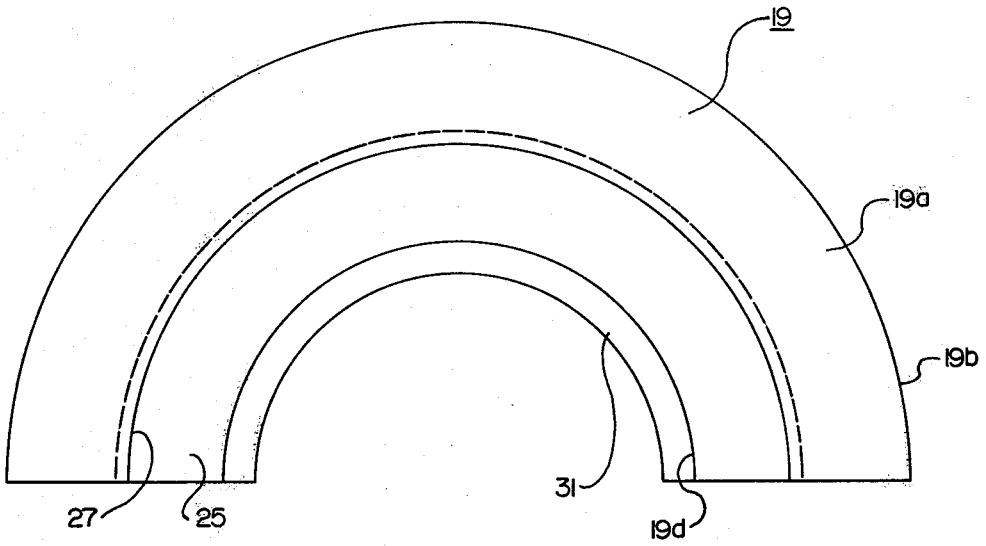
FIG. 3 is a top plan view of a portion of the valve lock means of the present invention.
Figure 4:
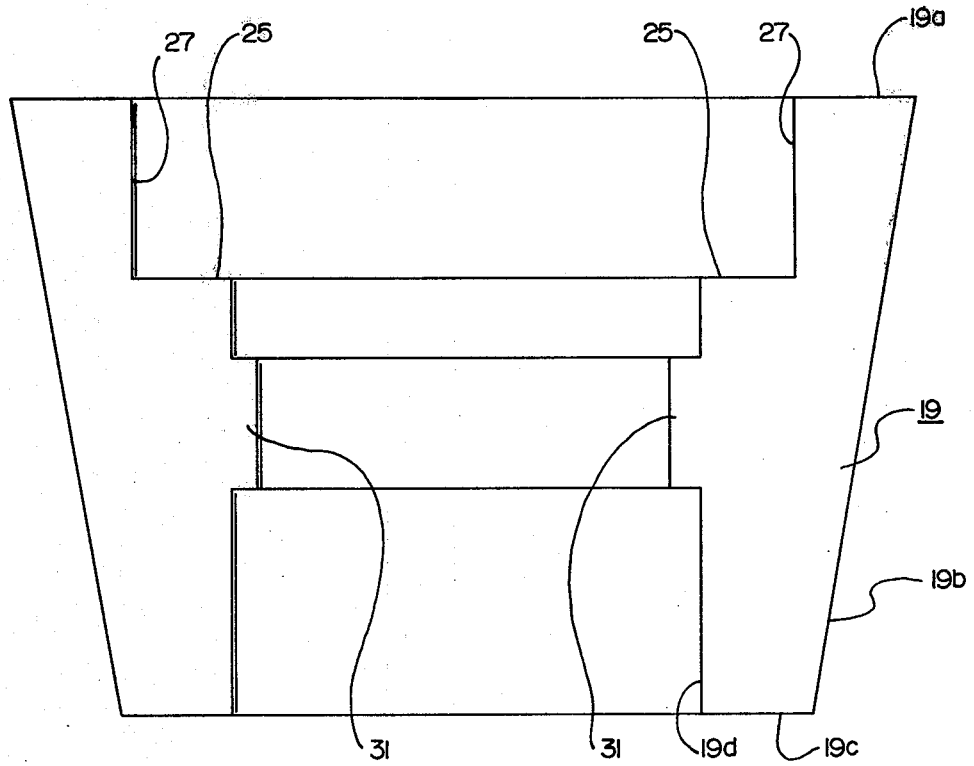
FIG. 4 is a side elevational view thereof.

The valve lock means 11 of the present invention is for use in a valve assembly of a high performance internal combustion motor or engine such as commonly used in the sport of automobile racing to lock or attach a valve spring retainer 13 to the distal end 15' of a valve stem 15 in such a manner that a typical cup-shaped lash cap 17 can be positioned or placed over the tip T of the distal end 15' of the valve stem 15 (see, in general, FIGS. 1 and 2). The purpose and operation of the valve spring retainer 13, valve stem 15 and lash cap 17 is not affected or changed by the valve lock means 11 of the present invention and is well known to those skilled in the art. In general, the valve lock means 11 of the present invention includes means for being wedged between the valve spring retainer 13 and the valve stem 15 to thereby lock or attach the valve spring retainer 13 and the valve stem 15 together as will be apparent to those skilled in the art, and for receiving a portion of the lash cap 17 (see, in general, FIG. 2).

Figure 5:
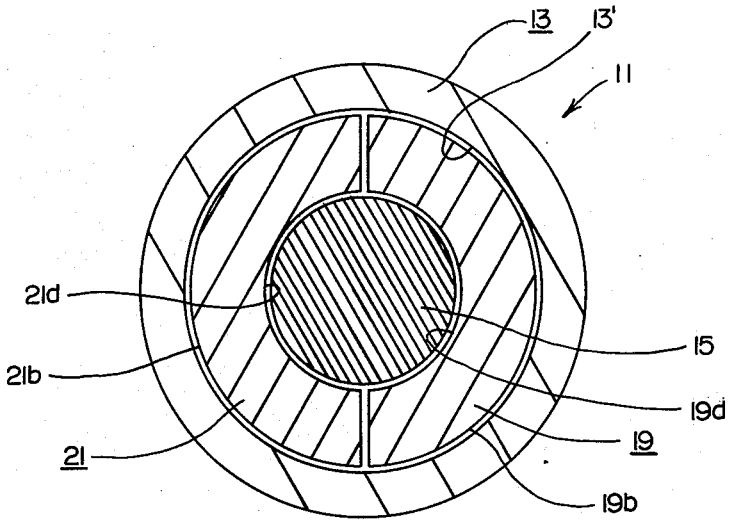
FIG. 5 is a sectional view of a portion of the valve lock means as taken from line V—V of FIG. 2.

Preferably, the valve lock means 11 of the present invention includes a first wedge-shaped key member 19 and a second wedge-shaped key member 21 for being wedged between the valve spring retainer 13 and the valve stem 15 as shown in FIGS. 2 and 5 to lock or attach the valve spring retainer 13 and the valve spring 15 together. Each key member 19, 21 preferably has a cavity or cavity-like portion 23 for receiving a portion of the lash cap 17. More specifically, a first end **19*a*, 21*a* of each key member 19, 21 is preferably provided with an offset consisting of a shoulder portion 25 and a wall portion 27** located conterminous with and substantially perpendicular to one another as clearly shown in FIGS.

2 and 4 so as to define the cavity-like portions 23 as will hereinafter become apparent.

The lash cap 17 includes a cup-like cavity 17′ substantially the same shape and size as the distal end 15′ of the valve stem 15 for allowing the lash cap 17 to be positioned or placed over the tip T of the valve stem 15 as shown in FIG. 2. The lash cap 17 includes an annular rim 17″ which, when the lash cap 17 is positioned or placed over the tip T of the valve stem 15, extends downward past the tip T of the valve stem 15 (see FIG. 2). The rim 17″ of the lash cap 17 extends into the cavity-like portions 23 of the key member 19, 21 as clearly shown in FIG. 2 with the rim 17″ of the lash cap 17 substantially contacting the shoulder portions 25 of the cavity-like portions 23 and with a portion of the outer wall 17‴ of the lash cap 17 contacting the wall portions 27 of the cavity-like portions 23.

Each key member 19, 21 preferably is in the form of or has the cross-sectional shape of substantially half a circular ring so that when the key members 19, 21 are placed substantially together they will form a substantially complete circular ring so as to substantially completely enclose the valve stem 15 as clearly shown in FIG. 5. The outer walls 19*b*, 21*b* of each key member 19, 21 preferably slopes inwardly from the first ends 19*a*, 21*a* thereof towards the second ends 19*c*, 21*c* thereof relative to the inner walls 19*d*, 21*d* thereof so that the key members 19, 21 will function as wedges to lock or attach the valve spring retainer 3 and the valve stem 15 together (see, for example, FIG. 2). The angle of the outer walls 19*b*, 21*b* of the key members 19, 21 is preferably substantially the same as the angle of the inner wall 13′ of the valve spring retainer 13. The inventor has determined that optimum strength is obtained when the outer walls 19*b*, 21*b* of the key members 19, 21 and the inner wall 13′ of the valve spring retainer 13 are at an angle of substantially 10° relative to the longitudinal axis of the valve stem 15.

The inner walls 19*d*, 21*d* of the first and second key members 19, 21 preferably include a projection 29 for coacting with a groove 31 provided in the distal end 15′ of the valve stem 15 remote from the tip T thereof (see FIG. 2) to allow, among other things well known to those skilled in the art, the key members 19, 21 and, therefore, the valve spring retainer 13 to be properly positioned relative to the tip T of the valve stem 15.

The key members 19, 21 of the valve lock means 11 are preferably constructed of titanium steel or the like in any manner apparent to those skilled in the art. The other components of the valve assembly may be constructed in any typical manner and of any typical material as now practiced and as well known to those skilled in the art. However, it should be noted that the angle of the inner wall 13′ of the valve spring retainer 13 should be substantially complementary with the angle of the outer walls 19*b*, 21*b* of the key member 19, 21 and that, as heretofore mentioned, these angles should be substantially 10° relative to the longitudinal axis of the valve stem 15 for optimum strength.

The use of the valve lock means 11 of the present invention is quite simple. The assembly procedures of the valve assembly utilizing the valve lock means 11 of the present invention is substantially identical to those of any typical prior valve assembly and will be apparent to those skilled in the art. For example, the first step is to compress the valve spring 33 and insert the valve spring retainer 13 over the distal end 15′ of the valve stem 15. Next, the key members 19, 21 are placed about the distal end 15′ of the valve stem 15 with the projections 21 extending into the groove 31. When the valve spring 33 is released, it will force the valve spring retainer 13 upward and into wedgeable engagement with the key members 17, 21 to thereby lock or attach the valve spring retainer 13 and the valve stem 15 together. It should be noted that they key members 19, 21 and the valve spring retainer 13 are shown spaced apart from one another in FIG. 2 for the sake of clarity. Next, the lash cap 17 is positioned or placed over the tip T of the valve stem 15 so that the rim 17″ and a portion of the outer wall 17‴ thereof will extend into an annular cavity-like portion defined by the exterior of the valve stem 15 and the shoulder portion 25 and the wall portion 27 of the key members 19, 21. Such a valve assembly, when used in a high performance internal combustion engine in conjunction with a roller-type rocker arm 35 or the like, is extremely secure from failure caused by movement of the valve spring retainer 13 relative to the valve stem 15.

As thus constructed and used, the present invention provides an improved valve lock means and an improved valve assembly which is extremely strong even when a lash cap is utilized therewith since the wedge-like key members of the lock means extend above the rim of the lash cap and surround or receive a portion of the body of the lash cap.

Although the present invention has been described and illustrated with respect to a preferred embodiment thereof it is not to be so limited since changes and modifications may be made therein which are within the full intended scope of the invention.

I claim:

1. A valve lock means for locking a valve spring retainer having an inner wall to the distal end of a valve stem in a valve assembly of the type including a cup-shaped lash cap for placement over the tip of said distal end of said valve stem, said lash cap having a substantially larger outside diameter than the largest outside diameter of said distal end of said valve stem, said valve lock means comprising: wedged-shaped means, having an enlarged cavity-like portion at the upper end of said wedge-shaped means and having inner walls extending downwardly from said cavity-like portion over a major portion of the length of said wedge-shaped means adjacent said valve stem, for being wedged between said valve spring retainer and said valve stem to lock said valve spring retainer and said valve stem together and for receiving a portion of said lash cap in said enlarged cavity-like portion, said valve lock means extending above said inner wall of said valve spring retainer, and said enlarged cavity-like portion extending outwardly beyond and being substantially larger than said inner walls of said wedge-shaped means.

2. The valve lock means of claim 1 in which said wedge-shaped means includes first and second wedge-shaped key members for being wedged between said valve spring retainer and said valve stem to lock said valve spring retainer and said valve stem together.

3. The valve lock means of claim 2 in which each of said key members has a cross-sectional shape of substantially half a circular ring and in which said cavity of each of said key members is adapted to receive a portion of substantially half of said lash cap.

4. The valve lock means of claim 3 in which said cavity-like portion includes a shoulder portion and a wall portion located conterminous with and substantially perpendicular to each other.

5. An improved valve assembly of the type including a valve spring retainer having an inner wall, a valve stem, and a cup-shaped lash cap for placement over the tip of the distal end of said valve stem, said lash cap having a substantially larger outside diameter than the largest outside diameter of said distal end of said valve stem, wherein the improvement comprises: a valve lock means for locking said valve spring retainer and said valve stem together, said valve lock means including wedge-shaped means, having an enlarged cavity-like portion at the upper end of said wedge-shaped means and having inner walls extending downwardly from said cavity-like portion over a major portion of the length of said wedge-shaped means adjacent said valve stem, for being wedged between said valve spring retainer and said valve stem to lock said valve spring retainer and said valve stem together and for receiving a portion of said lash cap in said enlarged cavity-like portion, said valve lock means extending above said inner wall of said valve spring retainer, said enlarged cavity-like portion extending outwardly beyond and being substantially larger than said inner walls of said wedge-shaped means.

6. The improved valve assembly of claim 5 in which said wedge-shaped means includes first and second wedge-shaped key members for being wedged between said valve spring retainer and said valve stem to lock said valve spring retainer and said valve stem together.

7. The improved valve assembly of claim 6 in which each of said key members has a cross-sectional shape of substantially half a circular ring.

8. The improved valve assembly of claim 7 in which said cavity-like portion includes a shoulder portion and a wall portion located conterminous with and substantially perpendicular to each other.

9. The combination with a valve assembly of the type include a valve, a valve stem extending from the valve, said valve stem having a distal end, a valve spring for urging said valve closed, a valve spring retainer having an inner wall, a cup-shaped lash cap positioned on said distal end of said valve stem, said lash cap having a substantially larger outside diameter than the largest outside diameter of said distal end of said valve stem, and a rocker arm for selectively applying pressure to said lash cap to cause said valve to open, of a valve lock means for locking said valve spring retainer to said distal end of said valve stem, said valve lock means comprising:

(a) a first wedge-shaped key member positioned between said distal end of said valve stem and said valve spring retainer, said first key member having a first end and a second end, said first end of said first key member having a cavity therein receiving a portion of said lash cap, said first key member having an inner wall extending downwardly from said cavity in said first key member to said second end, said first end of said second key member being adjacent the upper end of said inner wall of said valve spring retainer, and said cavity in said first key member extending outwardly beyond and being substantially larger than said inner wall of said first key member; and (b) a second wedge-shaped key member positioned between said distal end of said valve stem and said valve spring retainer, said second key member having a first end and a second end, said first end of said second key member having a cavity therein receiving a portion of said lash cap, said second key member having an inner wall extending downwardly from said cavity in said second key member to said second end, said first end of said second key member being adjacent the upper end of said inner wall of said valve spring retainer, and said cavity in said second key member extending outwardly beyond and being substantially larger than said inner wall of said key member.

10. The combination of claim 9 in which said cavity of each of said key members is defined by a shoulder portion and a wall portion located conterminous with and substantially perpendicular to each other.

11. An improved valve assembly of the type including a valve spring retainer having an inner wall, a valve stem having a distal end, and a cup-shaped lash cap for being positioned on the tip of said distal end of said valve stem and having a substantially larger outside diameter than the largest outside diameter of said distal end of said valve stem to increase the bearing surface of the tip of said distal end of said valve stem, wherein said improvement comprises: a hollow ring member for being positioned around said distal end of said valve stem and for locking said valve stem and said valve spring retainer together, said ring member having a first end and a second end, said first end of said ring member extending above said inner wall of said valve spring retainer, said first end of said ring member having a larger inside diameter than the outside diameter of said lash cap to provide an enlarged cavity to allow a portion of said lash cap to be encircled by said ring member, said ring member below said first end having inner walls defining a space for the reception of said valve stem, said second end of said ring member having an inside diameter smaller than the inside diameter of said first end thereof and substantially the same as the largest outside diameter of said distal end of said valve stem, said enlarged cavity of said ring member extending outwardly beyond said inner wall of said ring member to provide a cavity substantially larger in diameter than the diameter of said space defined by said inner walls.

12. The improvement of claim 11 in which said ring member includes first and second wedge-shaped key members, each of said first and second key members having a cross-sectional shape of substantially half a circular ring.

* * * * *